US007203991B2

(12) United States Patent
Stephens et al.

(10) Patent No.: US 7,203,991 B2
(45) Date of Patent: Apr. 17, 2007

(54) PORTABLE CLEANING MACHINE

(75) Inventors: Ronald J. Stephens, Rittman, OH (US); Gary M. Johns, Canton, OH (US); David W. Moine, North Canton, OH (US); Richard A. Wareham, Uniontown, OH (US)

(73) Assignee: The Hoover Company, North Canton, OH (US)

( * ) Notice: Subject to any disclaimer, the term of this patent is extended or adjusted under 35 U.S.C. 154(b) by 636 days.

(21) Appl. No.: 10/681,468

(22) Filed: Oct. 8, 2003

(65) Prior Publication Data

US 2005/0076467 A1 Apr. 14, 2005

(51) Int. Cl.
*A47L 11/30* (2006.01)

(52) U.S. Cl. ..... 15/320; 15/321; 15/334

(58) Field of Classification Search ..... 15/328, 15/329, 331, 334, 410, 414, 320, 321
See application file for complete search history.

(56) References Cited

U.S. PATENT DOCUMENTS 2,876,481 A 3/1959 Gerber et al. ..... 15/331
4,129,920 A * 12/1978 Evans et al. ..... 15/337
4,662,026 A * 5/1987 Sumerau et al. ..... 15/329
4,955,106 A 9/1990 Stein et al. ..... 15/335
5,504,970 A 4/1996 Neshat et al. ..... 15/334
5,507,068 A * 4/1996 Fan et al. ..... 15/320
5,787,546 A 8/1998 Bass et al. ..... 15/344
6,497,001 B2 12/2002 Di Nunzio et al. ..... 15/323

* cited by examiner

*Primary Examiner*—Terrence R. Till
(74) *Attorney, Agent, or Firm*—A. Burgess Lowe; Brett A. Schenck

(57) ABSTRACT

A cleaning apparatus for cleaning a surface is provided. The cleaning apparatus has a housing for movement along a surface with a suction nozzle assembly having an inlet and outlet provided on the housing. A recovery container is removably mounted to the housing. A hose having a first end detachably connected to the outlet of the suction nozzle and a second end in fluid communication with the recovery container floor-scrubbing machine is provided. A vacuum source is in fluid communication with the suction nozzle, hose, and recovery container for drawing dirt from the cleaning surface into the inlet of the suction nozzle and into. The cleaning apparatus further includes a handle movably connected to the housing and movable between a first position that locks the first end of the hose to the housing to a second position that unlocks the first end of the hose to the housing.

15 Claims, 3 Drawing Sheets

PORTABLE CLEANING MACHINE

BACKGROUND OF THE INVENTION

1. Field of the Invention

The present invention relates to a portable cleaning machine such as a carpet extractor.

2. Background Information

It is known in the prior art to provide a portable cleaning machine for cleaning surface. It would be desirable to provide such a cleaning machine that can be used for both floor cleaning and above the floor cleaning surfaces such as upholsteries and stairs. Further, it would be convenient to have the cleaning machine be converted from an upright type to a hand-held type for use in a variety of cleaning applications, such as vehicles, closets or other areas of limited maneuvering space. However, in many of theses cleaning machines, it requires some time and effort to convert the machine from one such cleaning mode or application to another. Often, additional parts such as an accessory hose with a suction nozzle and a conversion valve has to be incorporate in the cleaning machine so that it can be used to clean both the floor and above the floor cleaning surfaces.

Hence, it is an object of the present invention to provide a versatile cleaning machine that can be easily used to clean various surfaces in a variety of cleaning areas.

SUMMARY OF THE INVENTION

The foregoing and other objects of the present invention will be readily apparent from the following description and the attached drawings. In one aspect of the present invention, a cleaning apparatus for cleaning a surface is provided. The cleaning apparatus has a housing for movement along a surface with a suction nozzle assembly having an inlet and outlet provided on the housing. A recovery container is removably mounted to the housing. A hose having a first end detachably connected to the outlet of the suction nozzle and a second end in fluid communication with the recovery container floor-scrubbing machine is provided. A vacuum source is in fluid communication with the suction nozzle, hose, and recovery container for drawing dirt from the cleaning surface into the inlet of the suction nozzle and into. The cleaning apparatus further includes a handle movably connected to the housing and movable between a first position that locks the first end of the hose to the housing to a second position that unlocks the first end of the hose to the housing.

In another aspect of the present invention, a cleaning apparatus for cleaning a surface in which cleaning solution is dispensed to the surface and substantially simultaneously extracted along with the dirt on the surface in a continuous operation is provided. The cleaning apparatus comprises a housing with a recovery system mounted to the housing. The recovery system comprises a recovery tank removable mounted to the housing, a suction nozzle selectively mounted to the housing and usable in both the attached and detached position for cleaning the surface, and a suction source for drawing liquid and dirt from the surface through the suction nozzle and into the recovery tank. A liquid distribution system is mounted at least in part to the housing for dispensing liquid to the surface. The liquid distribution system includes a solution tank removably mounted to the housing for holding the cleaning solution.

In still another aspect of the invention, a cleaning apparatus for cleaning a surface comprises a base assembly for movement along a surface. A handle is movably connected to the base assembly for propelling the base assembly along the surface. A recovery system is mounted to the base assembly and comprises a recovery container removably mounted to the housing. The recovery system further comprises a suction nozzle selectively mounted to the housing and usable in both an attached position and in a detached position for cleaning the surface, and a suction source for drawing liquid and dirt from said surface through said suction nozzle and into said recovery container.

BRIEF DESCRIPTION OF THE DRAWINGS

The invention will now be described, by way of example, with reference to the attached drawings, of which.

DETAILED DESCRIPTION OF THE PREFERRED EMBODIMENT

Figure 1:
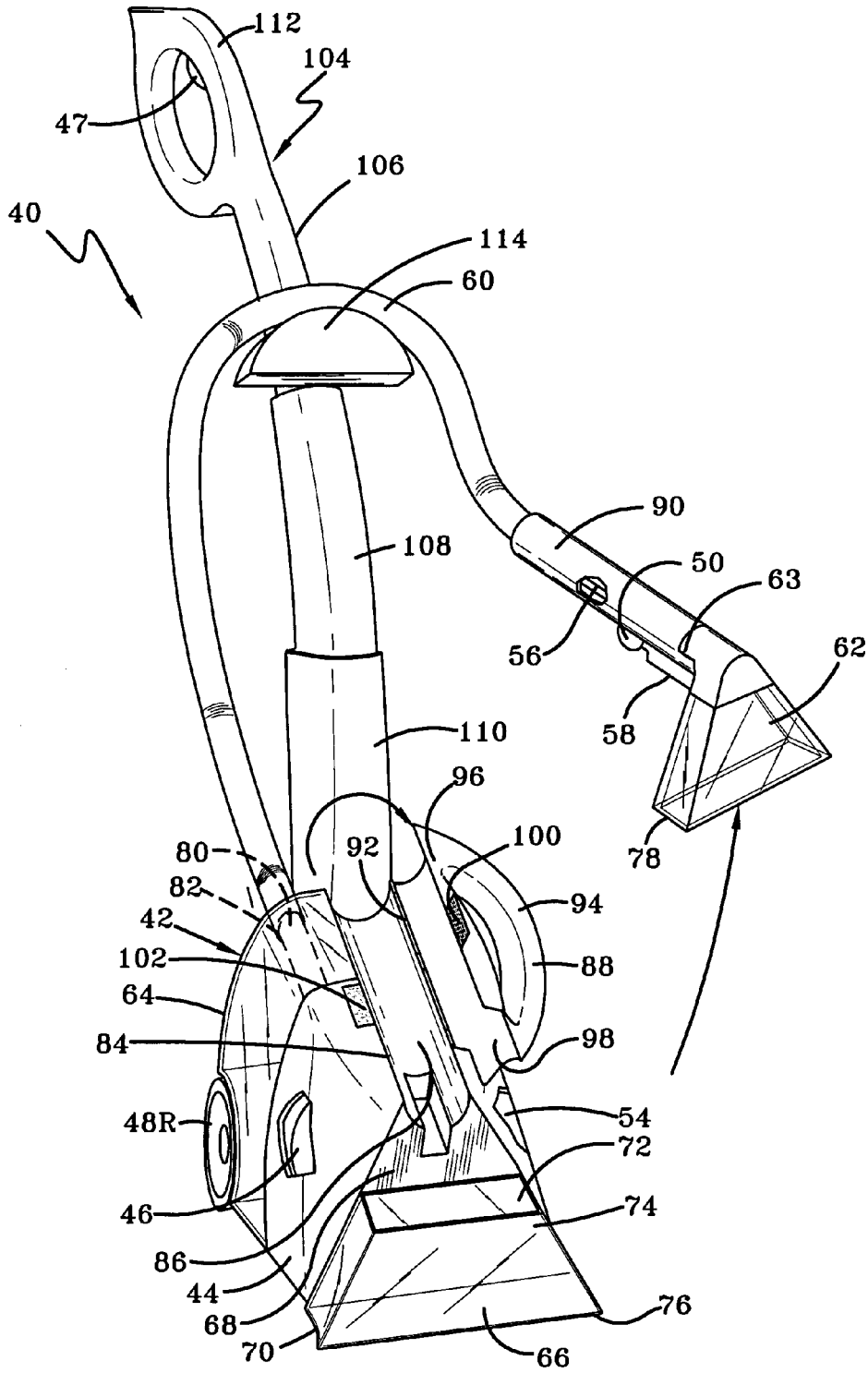
FIG. 1 is a front perspective view of the carpet extractor with portions cut away to illustrate hidden elements and with the hose nozzle detached from the housing of the carpet extractor according to the present invention.
Figure 3:
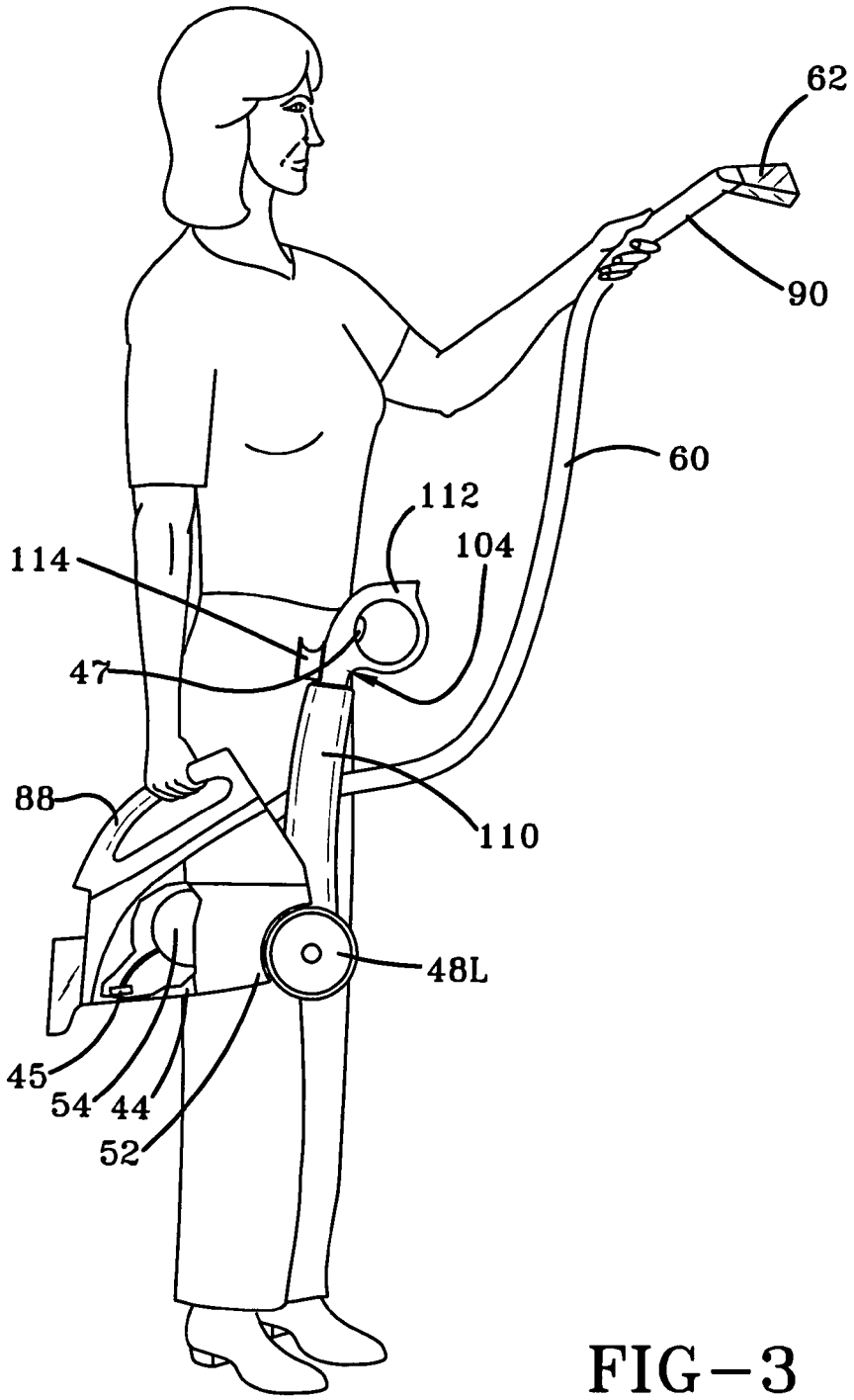
FIG. 3 is a left side perspective view of the carpet extractor with portions cut away to illustrate hidden elements and with the handle retracted and the hose nozzle detached from the housing of the carpet extractor for use as a hand-held extractor in cleaning above the floor surfaces.

In one embodiment of the present invention, an upright carpet extractor 40 that can be converted into hand-held is shown in FIG. 1. The base assembly 42 includes a frame or housing 44 that houses in part a suction motor/fan assembly 46. A suitable motor/fan assembly is shown in U.S. Pat. No. 5,500,977, the disclosure of which is incorporated by reference. The base assembly includes two laterally displaced wheels 48R, and 48L are rotatably attached to the rear of the housing 44. A supply tank assembly 52 is removably mounted to the housing 44 at the left rear portion thereof as shown in FIG. 3. A pump 54 is mounted to the base assembly 42 and fluid connected to the fluid supply tank assembly 52 for drawing the cleaning solution to a distributor 45 (FIG. 3) provided on the base assembly 42 or through a solution hose 56 to a spray mechanism 58 for a suction hose 60. The suction hose 60 has a nozzle 62 attached at its inlet end 63 through hose connector 90 that is selectively mounted to the housing 44 and usable in both an attached position and in a detached position (which will be explain further) for cleaning a surface. The pump 54 can be any suitable type, such as an air turbine driven type disclosed in the above-mentioned U.S. Pat. No. 5,500,977.

The spray mechanism 58 is mounted to the underside of the tubular hose connector 90 and operated by a trigger 50. The hose connector and spray mechanism is generally formed of a rigid material. The spray mechanism 58 can be any suitable device such as that disclosed in previously mentioned U.S. Pat. No. 5,500,977. Alternatively, the hose suction nozzle 62 could be detachably connected to the hose connector 90 of the hose 60, so that other nozzles or accessory tools such as a crevice tool or nozzle with an attached rotating brush could be attached to the hose 60 instead of the nozzle 62. A recovery tank 64 removably sets upon the housing 44 at the right rear portion of the housing 50 and is in fluid communication with the suction motor 46.

A trapezoidal shaped floor suction nozzle 66 is mounted to the front portion 68 of the housing 44 of the base assembly. The floor suction nozzle 66 has an inlet 70 formed at its bottom 76 extending across the width of the base assembly 42. The sides of the floor suction nozzle 66 converge into an outlet 72 at the upper portion 74 of the nozzle 66. The hose suction nozzle 62 is detachably attached to the housing 44 rearwardly adjacent the outlet 72 of the floor suction nozzle 66 and in fluid communication therewith. The hose suction nozzle 62 has an inlet 78, which is of substantially similar width as that of the outlet 72 of the floor suction nozzle 66, so that it fits over the outlet 72 of the floor suction nozzle 66. The hose suction nozzle 62 is generally triangularly shaped and attached to the hose connector 90, which is connected to the inlet 63 of the hose 60 as previously mentioned. The outlet end 80 of the hose 60 is attached to the housing 44 and is in fluid communication with the inlet 82 of the recovery tank 64. Alternatively, the hose 60 can be detachably connected to he inlet 82 of the recovery tank 64. The hose 60 is generally flexible, elongated, and corrugated throughout its length.

The housing 44 includes a middle portion 84 in which a channel 86 is formed on the upper surface of the middle portion 84 for receiving the hose connector 90 for the hose 60. The channel 86 extends from the front edge to the rear edge of the middle portion 84 and has a generally semicircular shaped cross section. A closed looped carry handle 88 is pivotally connected by a hinge 92 to the housing 44 adjacent the channel 86 and pivots along a longitudinal axis with respect to the carry handle 88. The carry handle 88 includes a curvilinear top section 94 for grasping by a hand of a user and a bottom section 96 that extends along the length of the channel 86. A channel 98 is formed on the underside of the bottom section 96 and complimentary fits over the hose connector 90 received in the channel 86 to releasably secure the hose 60, hose connector 90, and hose suction nozzle 62 to the housing 44. The spray mechanism 58 and trigger 50 is received in a recessed area within the channel 86. A suitable latching means such as a hook and pile fastener commonly know as Velcro® releasably secures the carry handle 88 to the housing 44.

In particular, hooks 100 attached to the underside of the bottom section 96 of the carry handle 88 are detachably connected to a complimentary pile strip 102 attached to the housing 44 adjacent the channel 86. To attach the hose 60, hose connector 90 and the hose suction nozzle 62 to the housing 44, a user first grasps the carrying handle 88 and pivots the carrying handle 88 away from the channel 86 as seen in FIG. 1. The user then inserts the hose connector 90 into the channel 86 and then pivots the carry handle 88 towards the channel 86 until the channel 98 of the bottom section 96 of the carrying handle 88 fits over the hose connector 90 and the hooks 100 attach to the pile strip 102.

An upright telescoping handle 104 is pivotally connected to the rear portion of the base assembly 42 for propelling the carpet extractor 40 across the surface. The handle 104 is collapsible so that the extractor 40 can be converted to a hand-held extractor as shown in FIG. 3. The handle 104 includes three telescoping sections 106, 108, 110. In particular, the upper section 106 terminates into a closed looped handgrip 112 (FIGS. 2 and 3) and is inserted into the middle section 108, which is inserted into the lower section 110. Thus, the upper section 106 has a smaller diameter than the middle section 108, which has a smaller diameter than the lower section 110. The telescoping sections 106, 108, 110 slide into their respective sections when the handle 104 is retracted with sufficient force applied to overcome the frictional sliding force of adjacent telescoping sections. A hose support member 114 is secured on the upper section for receiving the hose 60.

Figure 2:
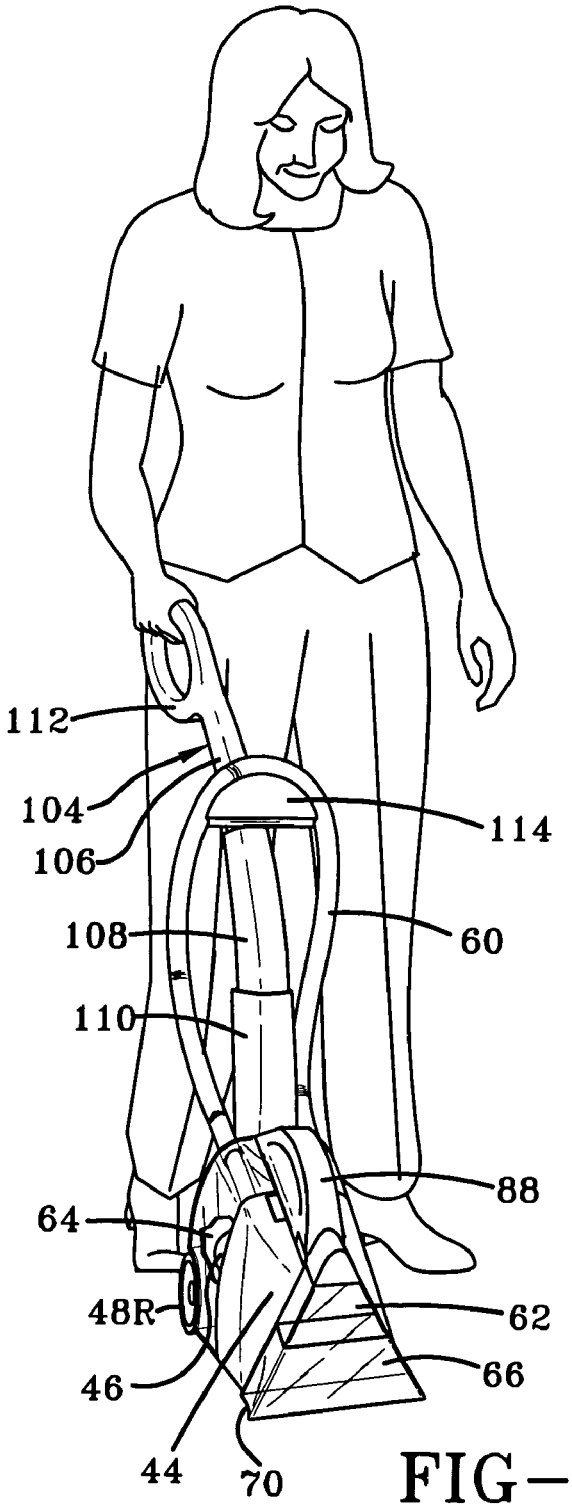
FIG. 2 is a front perspective view of the carpet extractor of FIG. 1 with the handle extended and the hose nozzle attached to the housing of the carpet extractor for use as an upright in cleaning floor surfaces.

When the carpet extractor 40 is in the floor cleaning position as shown in FIG. 2, the handle 104 is extended and the hose suction nozzle 62 is mounted on the housing 44 adjacent the outlet 72 of the floor suction nozzle 66 in fluid communication with the floor suction nozzle 66 for floor cleaning. In this position, the extractor 40 is an upright extractor. A suitable trigger switch 47 (FIG. 1) pivotally mounted on the handgrip 47 or alternatively on the base assembly 42 selectively controls the flow of cleaning solution to the distributor 45. In the above the floor cleaning position, the handle 104 is retracted to convert the extractor 40 to a hand-held extractor. The carry handle 88 is then pivoted away from the hose connector 90 to allow its removal from the housing 44. The hose 60, hose connector 90, and hose suction nozzle 62 can be then be used for above the floor cleaning as shown in FIG. 3. It should be noted that the extractor 40 can also be used as a hand-held extractor with the hose 60, hose connector 90, and hose suction nozzle 62 attached to the housing 44. Further, the extractor can be used as an upright extractor with the hose 60, hose connector 90, and hose suction nozzle 62 detached from the housing 44. Further, a brush assembly such as a horizontal brush roll can be rotatably mounted to the base assembly 42 to scrub the floor.

In general, the carpet extractor 40 distributes cleaning solution to the carpeted surface and substantially simultaneously extracts it along with the dirt on the carpet in a continuous operation. In particular, soiled cleaning liquid is extracted from the carpet by the floor suction nozzle 66 or hose suction nozzle 62, which communicates with the recovery tank 64 through the hose 60. The soiled cleaning solution travels through the hose 60 and hose connector 90 and into the recovery tank 64 where the liquid is separated by the air and collects on the bottom of the tank 64. A vacuum is created in the recovery tank 64 by the motor fan assembly 46 that draws air from the recovery tank 64 and exhausts the air to the carpeted surface.

The present invention has been described by way of example using the illustrated embodiment. Upon reviewing the detailed description and the appended drawings, various modifications and variations of the preferred embodiments will become apparent to one of ordinary skill in the art. All such obvious modifications and variations are intended to be included in the scope of the present invention and of the claims appended hereto.

What is claimed is:

1. A cleaning apparatus for cleaning a surface comprising:

a housing for movement along the surface;

a suction nozzle assembly provided on said housing having an inlet and an outlet;

a recovery container removably mounted to said housing;

a hose having a first end detachably connected to said outlet of said suction nozzle and a second end in fluid communication with said recovery container;

a vacuum source in fluid communication with said suction nozzle, said hose, and said recovery container for drawing dirt from the cleaning surface into the inlet of the suction nozzle and into said recovery container;

a first handle movably connected to said housing, said first handle being moved between a first position that locks the first end of said hose to said housing to a second position that unlocks the first end of said hose to said housing; and a liquid distribution system mounted at least in part to said housing for dispensing liquid to said surface, said liquid distribution system including a solution tank removably mounted to said housing for holding the cleaning solution.

2. The cleaning apparatus of claim 1 wherein said housing includes a channel formed therein for removably receiving at least a portion of said hose.

3. The cleaning apparatus of claim 2 wherein said first handle is pivotally connected to said housing.

4. The cleaning apparatus of claim 1 including a second handle operatively connected to the housing in a first position for propelling said cleaning apparatus along the surface.

5. The cleaning apparatus of claim 4 wherein said second handle is placed in a second position such that the cleaning apparatus can be used as a hand-held cleaning machine.

6. The cleaning apparatus of claim 5 wherein said second handle includes at least a first portion telescopically connected to a second portion, said first portion telescoping substantially into said second portion to place said handle in said second position.

7. The cleaning apparatus of claim 5 wherein said housing includes a channel formed therein for removably receiving at least a portion of said hose.

8. A cleaning apparatus for cleaning a surface in which cleaning solution is dispensed to the surface and substantially simultaneously extracted along with the dirt on the surface in a continuous operation comprising:

a housing;

a recovery system mounted to said housing and comprising:

a) a recovery tank removably mounted to said housing;

b) a suction nozzle selectively mounted to said housing and usable in both an attached position and in a detached position for cleaning said surface;

c) a suction source for drawing liquid and dirt from said surface through said suction nozzle and into said recovery tank, and a liquid distribution system mounted at least in part to said housing for dispensing liquid to said surface, said liquid distribution system including a solution tank removably mounted to said housing for holding the cleaning solution.

9. The cleaning apparatus of claim 8 including a handle operatively connected to the housing in a first position for propelling said cleaning apparatus along the surface.

10. The cleaning apparatus of claim 9 wherein said handle is placed in a second position such that the cleaning apparatus can be used as a hand-held cleaning machine.

11. The cleaning apparatus of claim 10 wherein said handle includes at least a first portion telescopically connected to a second portion, said first portion telescoping substantially into said second portion to place said handle in said second position.

12. A cleaning apparatus for cleaning a surface comprising a base assembly for movement along a surface;

a handle pivotally connected to the base assembly for propelling said base assembly along said surface;

a recovery system mounted to said base assembly and comprising:

a) a recovery container removably mounted to said base assembly;

b) a suction nozzle selectively mounted to said base assembly and usable in both an attached position and in a detached position for cleaning said surface; and c) a suction source for drawing liquid and dirt from said surface through said suction nozzle and into said recovery container.

13. The cleaning apparatus of claim 12 wherein said base assembly includes pair of wheels roratably mounted on opposite sides thereof.

14. A cleaning apparatus for cleaning a surface, comprising:

a base assembly for movement along the surface;

a handle movably connected to the base assembly for propelling the base assembly along the surface, wherein said handle is placed in a position such that the cleaning apparatus can be used as a hand-held cleaning machine; and a recovery system mounted to said base assembly and comprising a) a liquid recovery container removably mounted to said base assembly;

b) a suction nozzle selectively mounted to said base assembly and usable in both an attached position and in a detached position for cleaning the surface; and c) a suction source for drawing liquid and dirt from the surface through said suction nozzle into said liquid recovery container.

15. The cleaning apparatus of claim 14 wherein said handle includes at least a first portion telescopically connected to a second portion, said first portion telescoping substantially into said second portion to place said handle in said second position.

* * * * *